United States Patent [19]

Trujillo

[11] Patent Number: 4,585,017

[45] Date of Patent: Apr. 29, 1986

[54] MANICURISTS HAND HOLDER

[76] Inventor: Josephine M. Trujillo, 2205 S. Lucille, Seattle, Wash. 98108

[21] Appl. No.: 579,116

[22] Filed: Feb. 10, 1984

[51] Int. Cl.[4] ..... A45D 29/00

[52] U.S. Cl. ..... 132/73; D28/61

[58] Field of Search ..... 132/73, 73.5, 75, 75.6, 132/76.4, 76.5, 88.5, 93, 88.7; D28/56, 61

[56] References Cited

U.S. PATENT DOCUMENTS

| | | | |
|---|---|---|---|
| D. 135,041 | 2/1943 | White | D28/61 |
| D. 142,177 | 8/1945 | Walsh | D28/56 |
| D. 142,327 | 8/1945 | McPharlin | D28/61 |
| D. 155,239 | 9/1949 | Smith | D28/61 |
| D. 158,223 | 4/1950 | Schubert et al. | D28/61 |
| D. 161,667 | 1/1951 | Westmore | D28/61 |
| D. 189,175 | 11/1960 | McCarty | D28/61 |
| D. 226,736 | 4/1973 | Benis | D28/61 |
| 1,163,490 | 12/1915 | Weil | 132/73 |
| 2,171,804 | 9/1939 | Perez | 132/73 |
| 2,223,204 | 11/1940 | Carmichael | 132/73 |
| 2,392,626 | 1/1946 | Young | 132/73 |
| 2,393,371 | 1/1946 | Harris | 132/73 |
| 2,396,154 | 3/1946 | Campbell | 132/88.5 |
| 2,461,695 | 2/1949 | McMahon | 132/73 |
| 2,477,921 | 8/1949 | Batton et al. | 132/73 |
| 2,517,232 | 8/1950 | Patulski | 132/73 |
| 2,662,534 | 12/1953 | Swartz | 132/73 |
| 3,198,197 | 8/1965 | Van Halanger | 132/73 |
| 4,296,766 | 10/1981 | Benis | 132/73 |
| 4,321,935 | 3/1982 | Sussman | 132/73 |

*Primary Examiner*—Gene Mancene
*Assistant Examiner*—Carolyn A. Harrison
*Attorney, Agent, or Firm*—Christensen, O'Connor, Johnson & Kindness

[57] ABSTRACT

A hand holder for receiving and supporting the fingers of each hand for application of a manicuring treatment comprises a plastic piece having first and second surfaces molded on opposite sides thereof. Each surface has recessed contours for supporting the palm and fingers of one hand in spaced relation such that the nail of each finger is readily accessible for application of a manicuring treatment. The holder is turned over for use in treating the opposite hand.

15 Claims, 3 Drawing Figures

Fig. 1.
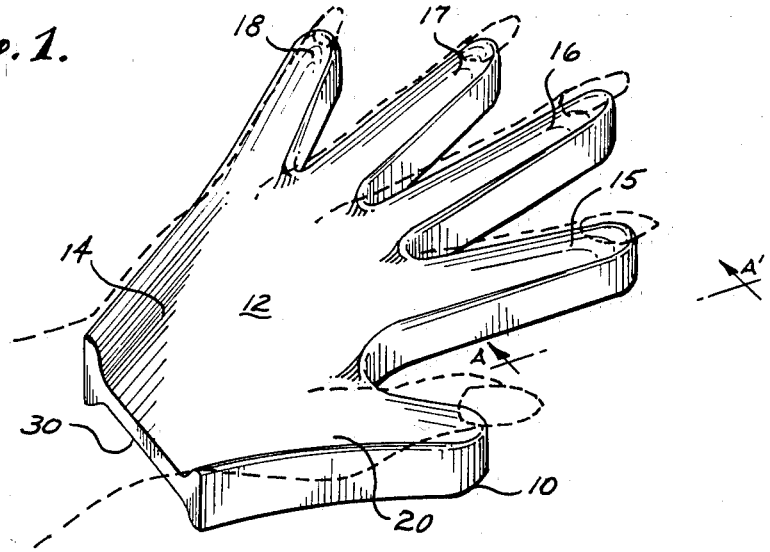
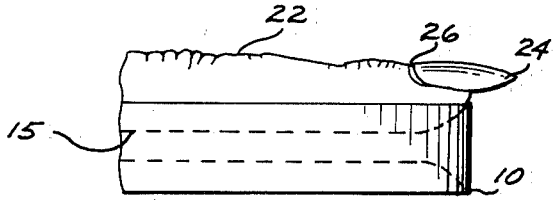
Fig. 2.
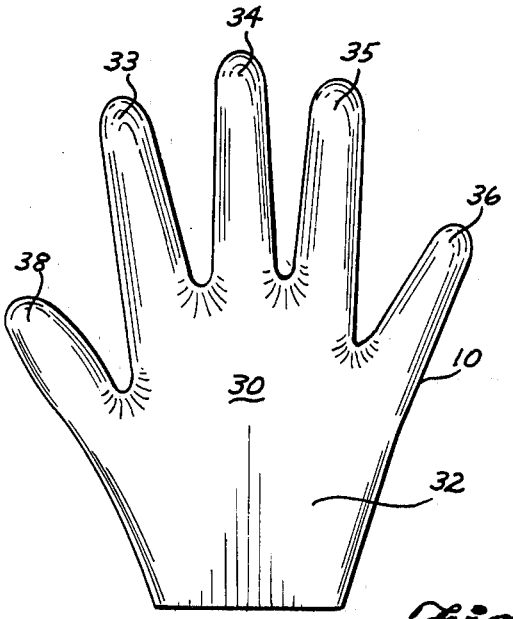
Fig. 3.

MANICURISTS HAND HOLDER

BACKGROUND OF THE INVENTION

The present invention pertains to the cosmetic application art and, more particularly, to a holder for receiving and supporting the digits of a human extremity for cosmetic treatment, such as a manicure or pedicure.

Numerous devices suitable for use in manicuring or pedicuring operations are known to the prior art. The desired function of such devices is to provide suitable support for the hand or foot with the fingers, or toes sufficiently held in position such that the nail on each digit is readily accessible for the application of enamel, polish, or to perform shaping of the nail or cuticle. While constraining the hand or foot in position, the device should be arranged such that the hand or foot is maintained in a comfortable position for an extended period of time.

Heretofore, such manicuring or pedicuring extremity restraining devices have suffered from numerous disadvantages. For example, many such devices do not provide adequate support to the hand or foot under treatment. That is, many existing manicuring devices do not sufficiently hold each finger in fixed position, whereby suitable treatment of the nail becomes difficult. Further, many such prior art manicuring devices allow the nails on a finger to contact adjacent fingers, or to contact the manicuring device itself. This results in smearing of the polish being applied.

The problem of those manicuring devices which exhibit insufficient support to the fingers is a direct result of the attempt in such devices to provide a single working surface which is adaptable for use with either hand. As a result, the finger receiving surfaces are not uniquely contoured to each hand and, as such, do not provide ample support.

One particular manicuring device known to the prior art provides ample support to the hand and is adaptable for unique support to either hand. However, this device employs numerous parts which must be assembled during each use of the manicuring device. As such, it is cumbersome in use, and relatively expensive to manufacture and maintain.

SUMMARY OF THE INVENTION

It is an object of this invention, therefore, to provide improved apparatus for the support of the digits of a human extremity for a cosmetic treatment.

Briefly, according to the invention, the inventive apparatus includes a unitary piece having first and second surfaces on opposite sides thereof. The first and second surfaces have recessed contours formed therein for receiving and supporting, in spaced relation, the digits of one of a left and right human extremity pair such that the nails on the extremity are readily accessible for cosmetic treatment.

Preferably, the first and second surfaces are aligned such that the recessed contours for corresponding digits on each extremity are formed directly opposite one another. This allows each extremity to be supported and received by its own unique contour, with the device merely being turned over for suitable support of the opposite extremity.

For manicuring treatment, the device preferably has recessed contours which are formed to receive and support the palm and finger portions of a human right hand at its first surface, with the second surface including recessed contours formed to receive and support the palm and finger portions of a human left hand. In addition, the manicuring apparatus is formed such that the plan view of the first surface is the shape of a human right hand, with a plan view of the second surface being the shape of a human left hand.

The device according to the invention may be easily constructed by means of molding the first and second surfaces into opposite sides of a plastic piece.

DETAILED DESCRIPTION OF THE DRAWINGS

FIG. 1 is a perspective view of the preferred embodiment of the inventive apparatus for use in the application of a manicure and illustrates a user's left hand in position on the manicuring device;

FIG. 2 is a side view, taken at A—A' of FIG. 1, illustrating the support provided by the manicuring device to an individual finger; and, FIG. 3 is a plan view of the right hand side of the manicuring device shown in FIG. 1.

DETAILED DESCRIPTION

FIG. 1 is a perspective view of the preferred construction of a manicuring device made in accordance with the present invention. The manicuring device 10 is, preferably, a single molded piece, although, as will be understood more fully hereinbelow, the manicuring device 10 need not be molded and could be made out of any other suitable material such as wood or metal. As shown, the manicuring device 10 is formed in the shape of a human hand having a top surface 12 (as shown in FIG. 1), in the shape of a human left hand. The manicuring device 10 includes a recessed contour 14 suitable for supporting and receiving a palm, recessed contours 15–18 suitable for supporting and receiving the index through small fingers, and a recessed contour 20 suitable for supporting and receiving the thumb. The dimensions of the manicuring device 10 are such that a typical hand rests comfortably within the contours 14, 15–18 and 20, without allowing significant movement of any digit. Further, when a hand is placed within the contours 14, 15–18 and 20 of the top surface 12, the nail on each finger is readily accessible for application of a manicure.

FIG. 2 is a side view taken at A—A' of FIG. 1, illustrating the receiving and supporting relationship between the manicuring device 10 and a received human finger 22. The depth of the recessed contour within the manicuring device 10 is designed such that a typical finger 22 is comfortably supported within the contour 15 while allowing ready access to the fingernail 24 and cuticle 26. Thus, nail polish and the like may be easily applied to the fingernail 24 without fear of the finger 22 moving during application, or during the drying process. In addition, any desired shaping to the fingernail 24 or the cuticle 26 may be accomplished easily, inasmuch as the finger 22 is supported in position.

A particular feature of the invention is that the undersurface 30 of the manicuring device 10 shown in FIG. 1 has contoured recesses for receiving and supporting the palm and fingers of the opposite, or right hand of the user. FIG. 3 is a plan view of the manicuring device 10 which has been flipped over for use with the right hand. Shown is a surface 30 (previously identified as the lower surface in FIG. 1), including a recessed portion 32 to receive and support the palm and contoured surfaces 33–36 receive each of the four fingers. The thumb of the right hand is received in recessed contour 38.

Use of the manicuring device 10 with the right hand is identical to that shown with respect to the left hand of FIG. 1.

It will be noted that the simplicity of the present device, and thus the economy realized in its manufacture, lies, in part, to the fact that the top and bottom surfaces 12, 30 are aligned such that the recessed contours for corresponding fingers on each hand are formed directly opposite one another. As such, the device is particularly simple in construction, particularly lending itself to molded plastic manufacturing techniques.

In summary, an improved device for supporting and holding the digits of an extremity for application of a cosmetic treatment has been described in detail. The device is both simple and economical to construct and use, while providing a high level of support and comfort to the extremity being treated.

While a preferred embodiment of the invention has been described in detail, it should be apparent that many modifications and variations thereto are possible, all of which fall within the true spirit and scope of the invention.

For example, whereas the preferred embodiment of the invention illustrated in FIGS. 1–3 is for a manicuring device, it will be understood that a corresponding apparatus for receiving a foot could easily be constructed for application of a pedicure.

The embodiments of the invention in which an exclusive property or privilege is claimed are defined as follows:

1. Apparatus for supporting the digits of a human extremity for cosmetic treatment comprising:

a unitary piece having first and second surfaces on opposite sides thereof, said first surface having recessed contours formed therein for receiving and supporting, in spaced relation, each of the digits of the right one of a left and right human extremity pair such that the nails on said digits are readily accessible for cosmetic treatment, said second surface having recessed contours formed therein for receiving and supporting, in spaced relation, each of the digits of the left one of a left and right human extremity pair such that the nails on said digits are readily accessible for cosmetic treatment.

2. The apparatus of claim 1, wherein said first surface recessed contours are formed to receive and support the palm and finger portions of a human right hand and said second surface recessed contours are formed to receive and support the palm and finger portions of a human left hand.

3. The apparatus of claim 1, wherein the plan view of said first surface is the shape of a human right hand and the plan view of said second surface is the shape of a human left hand.

4. The apparatus of claim 2, wherein the plan view of said first surface is the shape of a human right hand and the plan view of said second surface is the shape of a human left hand.

5. The apparatus of claim 1, wherein said first and second surfaces are aligned such that the recessed contours of corresponding digits on each extremity are formed directly opposite one another.

6. The apparatus of claim 2, wherein said first and second surfaces are aligned such that the recessed contours for corresponding fingers on each hand are formed directly opposite one another.

7. The apparatus of claim 3, wherein said first and second surfaces are aligned such that the recessed contours for corresponding digits on each extremity are formed directly opposite one another.

8. The apparatus of claim 4, wherein said first and second surfaces are aligned such that the recessed contours for corresponding fingers on each hand are formed directly opposite one another.

9. The apparatus of claim 1, wherein said first and second surfaces are molded into opposite sides of a plastic piece.

10. The apparatus of claim 5, wherein said first and second surfaces are molded into opposite sides of a plastic piece.

11. The hand holder of claim 1, wherein said first and second surfaces are aligned such that the recessed contours for corresponding fingers on each hand are formed directly opposite one another.

12. A hand holder for receiving and supporting the fingers of each hand for application of a manicure comprising:

a plastic piece having first and second surfaces molded on opposite sides thereof, each of said first and second surfaces having recessed contours for receiving and supporting, in spaced relation, the palm and fingers of a different one of a pair of hands such that the nail on each finger is readily accessible for application of a manicure.

13. The hand holder of claim 12, wherein the plan view of said first surface is the shape of a human right hand and the plan view of said second surface is the shape of a human left hand.

14. The hand holder of claim 12, wherein said first and second surfaces are aligned such that the recessed contours for corresponding fingers on each hand are formed directly opposite one another.

15. The apparatus of claim 1, wherein said first surface recessed contours are formed to receive and support the sole and toe portions of a human right foot and said second surface recessed contours are formed to receive and support the sole and toe portions of a human left foot.

* * * * *